United States Patent [19]

Inoue

[11] Patent Number: 4,659,646

[45] Date of Patent: Apr. 21, 1987

[54] SILVER SALT DIFFUSION TRANSFER PHOTOGRAPHIC MATERIAL

[75] Inventor: Noriyuki Inoue, Kanagawa, Japan

[73] Assignee: Fuji Photo Film Co., Ltd., Kanagawa, Japan

[21] Appl. No.: 745,975

[22] Filed: Jun. 18, 1985

[30] Foreign Application Priority Data

Jun. 18, 1984 [JP] Japan ..... 59-124725

[51] Int. Cl.[4] ..... G03C 5/54; G03C 1/02

[52] U.S. Cl. ..... 430/230; 430/232; 430/567; 430/568

[58] Field of Search ..... 430/230, 232, 567, 568

[56] References Cited

U.S. PATENT DOCUMENTS 3,765,889 10/1973 Young ..... 430/230

3,772,025 11/1973 Land ..... 430/232

3,779,764 12/1973 Moll et al. ..... 430/567

3,989,527 11/1976 Locker ..... 430/567

4,481,288 11/1984 Yamada et al. ..... 430/567

*Primary Examiner*—Richard L. Schilling

*Attorney, Agent, or Firm*—Sughrue, Mion, Zinn, Macpeak & Seas

[57] ABSTRACT

A silver salt diffusion transfer photographic material is described, having a silver halide emulsion layer comprising silver halide grains wherein at least 80 percent of the total number of said silver halide grains are accounted for by coarse silver halide grains larger than about 0.6 μm in diameter and fine silver halide grains smaller than about 0.4 μm in diameter, and said fine silver halide grains constitute at least 10 percent of the total number of silver halide grains.

6 Claims, No Drawings

SILVER SALT DIFFUSION TRANSFER PHOTOGRAPHIC MATERIAL

FIELD OF THE INVENTION

This invention relates to a diffusion transfer photographic material, and more particularly to a silver salt diffusion transfer photographic material.

BACKGROUND OF THE INVENTION

Image forming process by diffusion transfer is well known. Specifically, this technique comprises processing an imagewise exposed light-sensitive silver halide emulsion layer with an alkaline aqueous solution containing a developing agent and a silver halide solvent, to reduce the exposed silver halide grains to silver with the developing agent and convert the unexposed silver halide grains into a diffusible silver complex salt with the silver halide solvent, and transferring the silver complex salt to a silver precipitating agent-containing layer (image receiving layer) disposed in superimposition with said emulsion layer by way of imbibition, where the silver complex salt is reduced by the developing agent with the aid of the silver precipitating agent to provide a silver image. This technique is generally carried into practice by using a film unit which comprises a light-sensitive element having a light-sensitive silver halide emulsion layer on a support, an image receiving element having an image receiving layer containing a silver precipitating agent on a support, and a processing element comprising a rupturable container containing a viscous alkaline aqueous solution containing a developing agent, a silver halide solvent and a thickener. To begin with, the emulsion layer of the light-sensitive element is imagewise exposed and the light-sensitive element and image receiving element are laminated in such a manner that said emulsion layer faces said image receiving layer, and are passed between a pair of rollers so as to destroy said processing element and thereby spread said viscous alkaline aqueous solution therebetween, and, after the laminate is allowed to stand for a given time, the image receiving element is peeled apart from the light-sensitive element to provide a desired image formation on the image receiving layer.

In regard to the image receiving element for silver salt diffusion transfer photography, Japanese Patent Publication No. 32754/69 (corresponding to U.S. Pat. No. 3,671,241) discloses an image receiving material prepared by incorporating a silver precipitating agent in an alkaline-impermeable polymer by vacuum deposition technique, dissolving the same in a solvent for said polymer, coating the solution onto a support, and, after drying, treating the surface layer of the polymer layer by chemical means such as hydrolysis to render the surface alkali-permeable. Japanese Patent Publication No. 49411/76 describes a production method in which a silver precipitating agent is embedded during saponification of a cellulose ester layer or thereafter. This method provides an image receiving layer having high mechanical strength characteristics. U.S. Pat. No. 3,671,241 teaches a method of preparing an image receiving layer which comprises saponifying a cellulose ester layer in which a silver precipitating agent has been incorporated.

As regards the developing agent for silver halide grains, the silver halide developing agents of hydroxylamine type have been found to be especially valuable, for when this type of developing agent is employed in association with a silver image receiving layer of regenerated cellulose type, a silver transfer image can be obtained which does not require, at all or substantially, an after treatment. Particularly useful silver halide developing agents of hydroxylamine type are N-alkyl and N-alkoxyalkyl-substituted hydroxylamines. A number of such hydroxylamine compounds have been described in U.S. Pat. Nos. 2,857,274, 2,857,275, 2,857,276, 3,287,124, 3,287,125, 3,293,034, 3,362,961, and 3,740,221. Particularly effective and desirable hydroxylamines are those having the formula

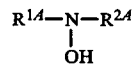

wherein $R^{1A}$ is an alkyl, alkoxyalkyl, or alkoxyalkoxyalkyl group, and $R^{2A}$ is a hydrogen atom or an alkyl, alkoxyalkyl, alkoxyalkoxyalkyl, or alkenyl group. Preferably, said alkyl, alkoxy, and alkenyl groups each contains from 1 to 3 carbon atoms. Among especially useful silver halide developing agents of the hydroxylamine type are N,N-diethylhydroxylamine, N,N-bis-methoxyethylhydroxylamine, and N,N-bis-ethoxyethylhydroxylamine.

Moreover, said developing agent may be used in combination with auxiliary developing agents, such as phenidone compounds, p-aminophenol compounds, and ascorbic acid.

As stated previously, the diffusion transfer system using a regenerated cellulose image receiving layer has the disadvantage of a long image formation time as compared with the system employing a colloidal silica image receiving layer, as described in U.S. Pat. No. 3,671,241.

Furthermore, it is mentioned in Japanese Patent Publication No. 29417/80 that when a regenerated cellulose layer containing a silver precipitating agent is used as the image receiving layer, the quality of the silver transfer image can be improved by using a silver halide photographic emulsion consisting substantially completely of silver halide grains layer than 0.5 μm in diameter.

However, it has been found that with silver halide photographic emulsions according to the above-mentioned patent literature, the image formation time is undesirably long and the maximum density of the transfer image is undesirably low.

SUMMARY OF THE INVENTION

One object of this invention is to provide a silver salt diffusion transfer photographic material containing a silver halide emulsion layer which ensures a fast transfer speed and a short image formation time.

Another object of this invention is to provide a silver salt diffusion transfer photographic product having an improved silver transfer image, and particularly with a high maximum density.

A further object of this invention is to provide a method for producing a silver diffusion transfer image, which ensures a fast transfer speed and a short image formation time when applied in association with a regenerated cellulose silver image receiving layer.

Still another object of this invention is to provide a silver halide photographic emulsion or a layer thereof which gives a high maximum density of the transfer image in silver salt diffusion transfer photography using a regenerated cellulose image receiving layer.

The above objects of this invention have been accomplished by a silver salt diffusion transfer photographic material having a silver halide emulsion layer comprising silver halide grains wherein at least 80 percent of the total number of said silver halide grains are accounted for by coarse silver halide grains larger than about 0.6 μm in diameter and fine silver halide grains smaller than about 0.4 μm in diameter, and said fine silver halide grains constitute at least 10 percent of the total number of silver halide grains.

DETAILED DESCRIPTION OF THE INVENTION

The above photographic material according to this invention may be provided in various preferred modes of embodiment, as described below.

One preferred embodiment is a silver salt diffusion transfer photographic material having a silver halide emulsion layer wherein at least 80 percent of the total number of said silver halide grains in said emulsion layer are accounted for by coarse silver halide grains larger than about 0.6 μm in diameter and fine silver halide grains of from about 0.1 to about 0.4 μm in diameter and said fine silver halide grains constitute at least 10 percent of the total number of silver halide grains.

Another preferred embodiment is a silver salt diffusion transfer photographic material having a silver halide emulsion layer wherein at least 80 percent of the total number of said silver halide grains in said emulsion layer are accounted for by coarse silver halide grains larger than about 0.7 μm in diameter and fine silver halide grains of from about 0.1 to about 0.4 μm in diameter, and said fine silver halide grains constitute at least 10 percent of the total number of silver halide grains.

A further preferred embodiment is a silver salt diffusion transfer photographic material having a silver halide emulsion layer wherein at least 80 percent of the total number of silver halide grains in said emulsion layer are accounted for by coarse silver halide grains larger than about 0.7 μm in diameter and fine silver halide grains of from about 0.1 to about 0.4 μm in diameter, and said fine silver halide grains constitute from 20 to 80 percent of the total number of silver halide grains.

Still another preferred embodiment is a silver salt diffusion transfer photographic material having a silver halide emulsion layer wherein at least 80 percent of the total number of silver halide grains in said emulsion layer are accounted for by coarse silver halide grains larger than about 0.8 μm in diameter and fine silver halide grains of from about 0.1 to about 0.4 μm in diameter, and said fine silver halide grains constitute from 20 to 80 percent of the total number of silver halide grains.

A still further preferred embodiment is a silver salt diffusion transfer photographic material having a silver halide emulsion layer wherein at least 80 percent of the total number of silver halide grains in said emulsion layer are accounted for by coarse silver halide grains larger than about 0.8 μm in diameter and fine silver halide grains of from about 0.1 μm to about 0.4 μm in diameter, and said fine silver halide grains constitute from 20 to 60 percent of the total number of silver halide grains.

Yet another preferred embodiment is a silver salt diffusion transfer photographic material having a silver halide emulsion layer wherein at least 80 percent of the total number of silver halide grains in said emulsion layer are accounted for by coarse silver halide grains of from about 0.7 μm to about 3.0 μm in diameter and fine silver halide grains of from about 0.1 μm to about 0.4 μm in diameter, and said fine silver halide grains constitute from 20 to 80 percent of the total number of silver halide grains.

A yet further preferred embodiment is a silver salt diffusion transfer photographic material having a silver halide emulsion layer wherein at least 80 percent of the total number of silver halide grains in said emulsion layer are accounted for by coarse silver halide grains of from about 0.8 μm to about 3.0 μm in diameter and fine silver halide grains of from about 0.1 μm to about 0.4 μm in diameter, and said fine silver halide grains constitute from 20 to 60 percent of the total number of silver halide grains.

An additional preferred embodiment is a silver salt diffusion transfer photographic material having a silver halide emulsion layer wherein at least 80 percent of the total number of silver halide grains in said emulsion layer are accounted for by coarse silver halide grains of from about 0.7 μm to about 3.0 μm in diameter and fine silver halide grains of from about 0.1 μm to about 0.4 μm in diameter, said fine silver halide grains constitute at least 10 percent of the total number of silver halide grains, and said coarse silver halide grains constitute from 80 to 20 percent of the total number of silver halide grains.

A still additional preferred embodiment is a silver halide diffusion transfer photographic material having a silver halide emulsion layer wherein at least 80 percent of the total number of silver halide grains in said emulsion layer are accounted for by coarse silver halide grains of from about 0.7 μm to about 3.0 μm in diameter and fine silver halide grains of from about 0.1 μm to about 0.4 μm in diameter, said fine silver halide grains constitute at least 10 percent of the total number of silver halide grains, and said coarse silver halide grains constitute from 80 to 40 percent of the total number of silver halide grains.

Still another additional preferred embodiment is a silver salt diffusion transfer photographic material including an image receiving layer made of regenerated cellulose containing a silver precipitating agent and being adapted for processing in the presence of a hydroxylamine developing agent and a silver halide solvent, which comprises a silver halide emulsion layer, wherein at least 80 percent of the total number of said silver halide grains in said emulsion layer are accounted for by coarse silver halide grains larger than about 0.6 μm in diameter and fine silver halide grains of from about 0.1 μm to about 0.4 μm in diameter and said fine silver halide grains constitute at least 10 percent of the total number of silver halide grains.

A yet additional preferred embodiment is a silver salt diffusion transfer photographic material including an image receiving layer made of regenerated cellulose containing a silver precipitating agent and being adapted for processing in the presence of a hydroxylamine developing agent and a silver halide solvent, which comprises a silver halide emulsion layer, wherein at least 80 percent of the total number of silver halide grains in said emulsion layer are accounted for by coarse silver halide grains of from about 0.7 μm to about 3.0 μm in diameter and fine silver halide grains of from about 0.1 μm to about 0.4 μm in diameter, said fine silver halide grains constitute at least 10 percent of the total number of silver halide grains, and said coarse silver halide grains constitute from 80 to 20 percent of the total number of silver halide grains.

A preferred silver halide emulsion layer used in this invention is formed by mixing a silver halide emulsion (emulsion L) comprising silver halide grains with an average particle diameter of not less than 0.7 μm with a silver halide emulsion (emulsion S) comprising silver halide grains with an average particle diameter not greater than 0.4 μm, and preferably in the range of about 0.1 μm to about 0.4 μm.

It is to be understood that two or more kinds of emulsion L and/or two or more kinds of emulsion S can be employed with equal success. The average particle diameter of silver halide grains in said emulsion L is preferably from 0.7 to 2.0 μm and that of emulsion S is preferably from 0.15 to 0.35 μm.

The silver halide in said emulsion L may, for example, be silver bromide, silver bromoiodide, or silver bromochloroiodide. Preferably, it is silver bromoiodide with a silver iodide content of not more than 10 mole percent, and for still better results it is silver bromoiodide containing from 3 to 10 mole percent of silver iodide.

The silver halide in said emulsion S may, for example, be silver bromide, silver bromoiodide, or silver bromochloroiodide and preferably silver bromide or either silver bromoiodide or silver bromochloroiodide which contains not more than 10 mole percent of silver iodide. For still better results, it is silver bromide or silver bromoiodide with a silver iodide content of not greater than 7 mole percent (still more preferably, of not greater than 1 mole percent).

In the context of this invention, the particle size of the silver halide emulsion is measured by electron microphotography.

The percentage of the number of silver halide grains is based on the number of particles.

The average diameter of silver halide grains in the context of this invention is the average diameter of the silver halide grains when the grains are spherical in shape, or the mean diameter of hypothetical spheres when the grains are cubic or other non-spherical shapes, as calculated from a circle of the same area as the projection of each silver halide grain.

The silver halide grains in said silver halide emulsion may have regular crystalline shapes such as cubic, octagonal, etc., or irregular crystalline shapes such as spherical, tabular, etc., or of a compound shape thereof. The emulsion may contain grains of various crystalline shapes. Emulsion S preferably comprises silver halide grains having a regular crystalline shape. Emulsion L preferably comprises silver halide grains of irregular shape.

While emulsion L may be a mono-emulsion of silver halide grains with a small individual variation or a multiple emulsion of grains with a large individual variation, the effects of this invention are more remarkable when a multiple emulsion is employed.

The term mono-emulsion is used to mean an emulsion such that the quantity $(s/\bar{r})$ of standard deviation (s) divided by mean particle diameter $(\bar{r})$ is not more than 0.20.

Emulsion S may be a mono-emulsion or a multiple emulsion, but the former is more advantageous for the purposes of this invention.

The silver halide grain may be composed of different phases for the core and the surface layer, or may constitute a homogeneous phase. The grain may be such that the latent image is formed mainly on the surface, or it may be such that the latent image is formed mainly internally.

Internal latent image silver halide emulsions may be used for both the emulsions L and S, but preferably surface latent image silver halide emulsions are employed.

Photographic emulsions to be employed in this invention can be prepared by the processes described in P. Glafkides, *Chimie et Physique Photographique* (published by Paul Montel, 1967); G. F. Duffin, *Photographic Emulsion Chemistry* (The Focal Press, 1966); V. L. Zelikman et al, *Making and Coating Photographic Emulsion* (The Focal Press, 1964); etc. Thus, any of the acid process, the neutral process and the ammonia process can be employed. For the reaction of a soluble silver salt with a soluble halide, any of the single-jet method, double-jet method and a combination thereof may be utilized.

It is also possible to use a method in which grains are formed in the presence of the excess of silver ion (the so-called reverse mixing method). As a version of the double-jet method, the process in which pAg in the liquid phase in which the silver halide is formed is maintained at a constant level, that is the so-called controlled double-jet method, may also be employed.

It is also possible that a cadmium salt, zinc salt, lead salt, thallium salt, iridium salt or a complex salt thereof, a rhodium salt or a complex salt thereof, or an iron salt or complex salt, for instance, may be allowed to be present in the course of formation of silver halide grains or during physical ripening in order to control sensitization and gradation.

Usually, soluble salts are removed from the emulsion after precipitation or physical ripening. This procedure may be carried out in various manners, for example by the time-honored noodle method which involves gelation of gelatin, or by the flocculation method employing an inorganic salt having a polyvalent anion (e.g., sodium sulfate), an anionic surfactant, an anionic polymer (e.g., polystyrenesulfonic acid) or a gelatin derivative (e.g., aliphatic acylated gelatin, aromatic acylated gelatin). This step of soluble salt removal may be omitted.

The silver halide emulsion is generally sensitized chemically, although a so-called primitive emulsion may also be used without chemical sensitization. For the chemical sensitization, those methods that are described by Glafkides, Duffin, and Zelikman in the texts cited above, or in *Grundlagen der Photographischen Prozesse mit Silberhalogenidemulsionen,* edited by H. Frieser, Akademische Verlaggesellschaft (1968) may be used.

As the emulsion S, a primitive emulsion may be employed, but a chemically sensitized emulsion is preferred.

The emulsion L can be a primitive emulsion, but is preferably a chemically sensitized emulsion.

For the purpose of preventing fogging during manufacture, storage or photographic processing of the photographic material or for stabilizing its photographic characteristics, various compounds can be incorporated in the photographic emulsions of this invention. Thus, there may be employed thiazoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiaziazoles, aminotriazoles, benzotriazoles, nitrobenzotriazoles, mercaptotetrazoles (especially 1-phenyl-5-mercaptotetrazole), etc., mercaptopyrimidines, mercaptotriazines, thioketo compounds such as oxazolinethione, etc., azaindenes such as triazaindenes, tetraazaindenes (especially 4-hydroxy-substituted (1,3,3a,7)tetrazaindenes), pentazaindenes, etc., benzenethiosulfonic acid, benzenesulfinic acid, benzenesulfonamides, lipoic acids as described in Japanese Patent Publication No. 25339/76 (corresponding to U.S. Pat. No. 3,859,100), and other known antifogging agents or stabilizers.

Further examples of emulsions and detailed methods for using them are described, e.g., in U.S. Pat. Nos. 3,954,474 and 3,982,947, and Japanese Patent Publication No. 28660/77.

The photographic emulsions used in accordance with this invention may be spectrally sensitized with methine dyes and other spectral sensitizing dyes. Such sensitizing dyes include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to the cyanine, merocyanine, and complex merocyanine series.

In the practice of this invention, preferably a plurality of sensitizing dyes are used in combination, as described in Japanese Patent Application No. 225306/82 (corresponding to U.S. patent application Ser. No. 563,488).

In the practice of this invention, it is advantageous to have each of the emulsion L and the emulsion S spectrally sensitized, and it is generally preferable that the emulsion L and the emulsion S be first mixed, and then spectrally sensitized.

Examples of preferred layer constructions for the light-sensitive element including the silver halide emulsion layer for use in the silver salt diffusion transfer photographic material of this invention are described below.

A first example is a structure consisting of a titanium dioxide-containing polyethylene terephthalate film support having a subbing layer on either side, a silver halide emulsion layer on one side of said support, a protective layer superimposed thereon, a carbon black layer on the other side of said support, and a protective layer superimposed thereon.

A second example is a structure consisting of a titanium dioxide- or carbon black-containing polyethylene terephthalate film support having a subbing layer on either side, a titanium dioxide layer on one side of said support, a silver halide emulsion layer superimposed thereon, a protective layer on top thereof, and a carbon black layer on the other side of said support.

A third example is a structure consisting of a transparent polyethylene terephthalate film support having a subbing layer on either side, a silver halide emulsion layer on one side of said support, a protective layer superimposed thereon, and a carbon black or color dye layer on the other side of said support.

A fourth example is a structure consisting of a carbon black- or color dye-containing polyethylene terephthalate film support having a subbing layer on either side, a silver halide emulsion layer on one side of said support, a protective layer superimposed thereon, and a carbon lack or color dye layer on the other side of said support.

A fifth example is a structure consisting of a carbon black- or color dye-containing polyethylene terephthalate film support having a subbing layer on either side, a silver halide emulsion layer superimposed on one side of said support, and a protective layer on top thereof. The reverse side of this structure may have a backing layer free of carbon black or color dye.

A sixth example is a structure consisting of a laminate film support made of a titanium dioxide-containing polyethylene terephthalate film and a carbon black-containing polyethylene terephthalate film, a subbing layer on either side of said laminate film support, a silver halide emulsion layer on one side of the subbed support, a protective layer superimposed thereon, a carbon black layer on the other side of said subbed support.

A seventh example is a structure consisting of a laminate film support made of a carbon black-containing paper sheet, a titanium dioxide-containing polyethylene layer on one side thereof and a polyethylene layer on the other side, a subbing layer on either side of said laminate support, a silver halide emulsion layer on one side of the subbed support, a protective layer superimposed thereon, and a carbon black layer on the other side of said subbed support.

An eighth example is structure consisting of a laminate film support made of a carbon black-containing paper sheet, a titanium dioxide-containing polyethylene layer on one side thereof and a polyethylene layer on the other side, a subbing layer on either side of said laminate support, a titanium dioxide layer, a silver halide emulsion layer, and a protective layer, as superimposed in succession on one side of the subbed laminated support, and a carbon black layer on the other side of said subbed laminate support.

A ninth example is a structure consisting of a laminate film support made of a paper sheet and a polyethylene sheet on either side thereof, a subbing layer on either side of said laminate support, a carbon black layer, a silver halide emulsion layer, and a protective layer, as superimposed in succession on one side of the subbed laminate support, and a carbon black layer on the other side.

Other white pigments may be used instead of said titanium dioxide, or titanium dioxide and such other white pigments may be used in combination.

The silver halide emulsion layer, protective layer and carbon black layers mentioned above generally contain a hydrophilic binder such as gelatin.

The photographic material according to this invention is preferably a very light-sensitive material as described above or a material including such. The image receiving layer to be used in association with said light-sensitive material is preferably an image receiving element having an image receiving layer on a support independent of the support of the light-sensitive material. This invention may also be practiced by using a photographic material carrying said light-sensitive silver halide emulsion layer and image receiving layer on one and the same support.

The silver halide emulsion layer and other hydrophilic colloid layer may contain a coating aid, examples of which include those described in *Research Disclosure,* Vol. 176, RD No. 17643, p. 26 (December, 1978) under the heading of Coating Aids.

The silver halide photographic emulsion and other hydrophilic colloid layers may further contain antistatic agents, plasticizers, antifoggants, etc.

As the vehicle for the silver halide emulsion used in this invention, any of those described in *Research Disclosure,* Vol. 176, RD No. 17643, p. 26 (December, 1978) under the heading of Vehicle and Vehicle Extenders can be employed.

The silver halide emulsion layer is coated on the support, if desired together with other photographic layers. As to the coating method, methods as described in *Research Disclosure,* Vol. 176, RD No. 17643, pp. 27–28 (December, 1978) under the heading of Coating and Drying Procedures can be employed. The support may be selected from among those described in *Research Disclosure,* Vol. 176, RD No. 17643, p. 28 (December, 1978) under the heading of Supports.

For increased sensitivity, increased contrast or accelerated development, the light-sensitive silver halide emulsion to be used in this invention may contain such compounds as polyalkylene oxides and their ether, ester, amine, and other derivatives, thioethers, thiomorpholines, quaternary ammonium compounds, urethane derivatives, urea derivatives, imidazole derivatives, 3-pyrazolidones, etc. For example, the compounds described in U.S. Pat. Nos. 2,400,532, 2,426,549, 2,716,062, 3,617,280, 3,772,021 and 3,808,003 can be employed.

In the photographic material of this invention, an inorganic or organic hardener can be incorporated in the light-sensitive emulsion layer and/or other hydrophilic colloid layer. For example, chromic acid salts (chromium alum, chromium acetate, etc.), aldehydes (formaldehyde, glyoxal, glutaraldehyde, etc.), N-methylol compounds (dimethylolurea, methyloldimethylhydantoin, etc.), dioxane derivatives (2,3-dihydroxydioxane, etc.), active vinyl compounds (1,3,5-triacroylhexahydro-s-triazine, 1,3-vinylsulfonyl-2-propanol, etc.), active halogen compounds (2,4-dichloro-6-hydroxy-s-triazine, etc.), mucohalogenic acid compounds (mucochloric acid, mucophenoxychloric acid, etc.) and others can be used alone or in combination.

For improved dimensional stability and other purposes, a dispersion of a synthetic polymer either insoluble or sparingly soluble in water may be added to the light-sensitive emulsion layer and/or other hydrophilic colloid layer of the photographic material of this invention. By way of illustration, such polymer may be a polymer composed of one or more monomers such as alkyl (metha)acrylates, alkoxyalkyl (metha)acrylates, glycidyl (metha)acrylates, (metha)acrylamides, vinyl esters (e.g., vinyl acetate), acrylonitrile, olefins, styrene, etc. or a polymer prepared by using such monomers in combination with other monomeric compounds such as acrylic acid, methacrylic acid, $\alpha,\beta$-unsaturated dicarboxylic acids, hydroxyalkyl (metha)acrylates, sulfoalkyl (metha)acrylates, styrenesulfonic acid, etc.

The light-sensitive silver halide emulsion and other hydrophilic colloid layers of the photographic material according to this invention may contain various dyes as filter dyes or for preventing irradiation or other purposes. It may contain an ultraviolet absorber, too.

A protective layer may be superimposed on the silver halide emulsion layer. The protective layer is composed of a hydrophilic high molecular weight compound such as gelatin and may contain matting agents and/or lubricants such as silica, polymethyl methacrylate latex, etc.

Exposure for a photographic image can be effected in the known manner. Thus, any of the known light sources such as natural light (sunlight), tungsten light, fluorescent light, mercury-vapor light, xenon arc light, carbon arc light, xenon flash light, cathode ray tube flying spot, etc., can be employed. The exposure time may be the exposure time range for the usual camera, i.e., 1/1000 to 1 second, or may be shorter than 1/1000 second, for example, $1/10^4$ to $1/10^6$ second with a xenon flash lamp or a cathode ray tube. The exposure time may be longer than 1 second. If desired, the spectral composition of exposure light may be adjusted by means of a color filter. Laser light may also be used for exposure. Exposure may also be accomplished with the light emitted from a phosphor excited by electron rays, X-rays, $\gamma$-rays, $\alpha$-rays, or the like.

An image receiving layer of regenerated cellulose containing a silver precipitating agent is employed with advantage in this invention. The image receiving element including an image receiving layer is described below.

The image receiving element includes a support for the silver precipitating agent-containing regenerated cellulose layer, such as supports of baryta paper, polyethylene-paper laminate, cellulose triacetate, polyester, etc. To prepare such an image receiving element, an optionally undercoated support is coated with a coating solution containing an appropriate cellulose ester, for example cellulose diacetate, with a silver precipitating agent dispersed therein. The cellulose ester layer obtained is then subjected to alkaline hydrolysis to thereby convert that part of cellulose ester which is in the direction of depth to cellulose. In a particularly useful embodiment, that portion of the cellulose ester which contains the silver precipitating agent and/or the cellulose ester (e.g., cellulose diacetate) in the underlying unhydrolyzed layer and has not undergone hydrolysis contains at least one mercapto compound or the like suited for improving the color tone, stability, and other photographic characteristics of the silver diffusion transfer image. Such mercapto compound is utilized after diffusion from original locations thereof during imbibition. This type of image receiving element is described in U.S. Pat. No. 3,607,269.

Another hydrophilic polymer layer may be provided as necessary between the silver precipitating agent-containing hydrolyzed cellulose ester layer and the underlying cellulose ester or partly hydrolyzed cellulose ester layer which may contain the above-mentioned mercapto compound. Polymers usable in said hydrophilic layer include gelatin, gelatin derivatives (e.g., phthalated gelatin), sugars (e.g., starch, galactomannan, gum arabic, hydroxyethylcellulose, methylcellulose, carboxymethylcellulose, pullulan, hydroxypropylcellulose), synthetic hydrophilic polymers (e.g., polyacrylamide, polymethylacrylamide, poly-N-vinylpyrrolidone, 2-hydroxyethylmethacrylate polymer), etc.

An alkali neutralizing agent layer may also be provided if desired. In this alkali neutralizing agent layer, there is used, for instance, a polymer acid described in Japanese Patent Publication No. 33697/73 (corresponding to U.S. Pat. No. 3,594,165).

Suitable silver precipitating agents that may be used include heavy metals such as iron, lead, zinc, nickel, cadmium, tin, chromium, copper, cobalt, and in particular noble metals such as gold, silver, platinum, and palladium. Other useful silver precipitating agents are heavy metal sulfides and selenides, in particular sulfides of mercury, copper, aluminum, zinc, cadmium, cobalt, nickel, silver, lead, antimony, bismuth, cerium and magnesium and selenides of lead, zinc, antimony, and nickel. The function of the silver precipitating agent in the silver salt diffusion transfer process is described, for example, in U.S. Pat. No. 2,774,667.

The image-receiving element may contain various additives (e.g., hardener, brightening agent, and coating aid) as desired.

The developing agent to be used in the practice of the invention is preferably a hydroxylamine developing agent such as mentioned hereinabove. A phenidone compound is used in combination as an auxiliary developing agent.

The silver halide solvent to be used in the practice of the invention may be an alkali metal thiosulfate, such as sodium thiosulfate or potassium thiosulfate, or, preferably, a cyclic imide of the type described in U.S. Pat. Nos. 2,857,274, 2,857,275, and 2,857,276, such as uracil, urazole or 5-methyluracil.

The processing composition contains an alkali, preferably an alkali metal hydroxide, such as sodium hydroxide or potassium hydroxide. In case the processing composition is applied in the form of a thin layer distributed between the light-sensitive element and image-receiving element that are overlapping each other, said processing composition preferably contains a polymer film-forming agent, a thickening or viscosity-increasing agent. Hydroxyethylcellulose and sodium carboxymethylcellulose are particularly useful for this purpose and are contained in the processing composition in concentrations at which an appropriate viscosity is obtained on the basis of known principles of diffusion transfer photographic processes. Said processing composition may further contain other auxiliaries known in the art of silver salt diffusion transfer, such as an antifogging agent, toning agents, a stabilizer, etc. Useful as said antifogging and toning agents are mercapto compounds, imidazole compounds, indazole compounds, and triazole compounds, among others. Particularly effective are compounds as described in U.S. Pat. Nos. 3,565,619 3,756,825 and 3,642,473, British Pat. No. 1,122,158 and West German Patent Application (OLS) No. 1,804,365. It has been found that the addition, as a stabilizer, of an oxyethylamino compound, such as triethanolamine, is particularly useful in increasing the storage life of the processing composition, as described in U.S. Pat. No. 3,619,185.

The constitution according to the invention makes it possible to obtain a satisfactory silver diffusion transfer image in a short image forming period. In particular, the use of an image-receiving element comprising a silver precipitating agent-containing regenerated cellulose layer can result in production of improved silver diffusion transfer images.

The above effect cannot be anticipated from the description in Japanese Patent Publication No. 29417/80 (corresponding to U.S. Pat. No. 3,765,889) which mentions that an improved highlight effect can be attained when substantially all halide grains are not smaller than 0.5 μm in diameter, namely, when grains smaller than 0.5 μm in diameter are present only in an amount of not more than 1%, that is, substantially absent.

The above-mentioned improvement in highlight indicates that a low minimum density is obtained in silver diffusion transfer images, and one having ordinary skill in the art would expect that the use of fine grains, which constitutes one of the characteristic features of the present invention, should result in a high minimum density, thus failing to afford good silver diffusion transfer images.

It is therefore quite unexpected that when coarse silver halide grains contain at least 10%, preferably from 20 to 80%, and more preferably from 20 to 60%, of fine grains not greater than about 0.4 μm in size in accordance with the constitution of the invention, the minimum density does not increase, but a high maximum density can be obtained.

EXAMPLE 1

Silver halide grains were prepared by the double-jet method and subjected to physical ripening at 65° C. for 30 minutes, desalting and chemical ripening to give a silver bromoiodide emulsion (iodine content 6.5 mole%). The silver halide grains in this emulsion (referred to as "A" emulsion) had a mean diameter of 1.1 microns, with grains having 0.4 micron or less in diameter accounting for only 7%.

In addition, a silver bromoiodide emulsion (iodine content 1 mole%) was prepared by the so-called controlled double-jet method in which the pAg in the liquid phase during formation of silver halide grains was kept constant. The mean diameter of silver halide grains in this emulsion (referred to as "B" emulsion) was 0.25 micron, and the emulsion contained no grains as large as or in excess of 0.40 micron.

Similarly, a silver bromoiodide emulsion (iodine content 6.5%) was prepared by the controlled double-jet method. This emulsion (referred to as "C" emulsion) had a mean silver halide grain size of 0.30 micron, with no less than 90% of all the grains measuring 0.40 microns.

The above 3 emulsions, "A", "B" and "C", were dissolved and mixed at 40° C. as specified in Table 1. To 1 kg each of the mixtures (silver halide content 0.65 mole for "A", "B" and "C", respectively) were added 200 ml of a 0.02 wt% solution of 3-{5-chloro-2-[2-ethyl-3-(3-ethyl-2-benzothiazolinylidene)propenyl]-3-benzoxazolio}propane sulfonate in methanol, 200 ml of a 0.02 wt% solution of 4-{2-[3-ethylbenzothiazolin-2-ylidene)-2-methyl-1-propenyl]-3-benzothiazolio}propanesulfonate in methanol, 100 ml of a 1 wt% aqueous solution of 4-hydroxy-6-methyl-1,3,3a,7-tetrazaindene, 10 ml of a 1 wt% solution of lipoic acid in methanol and 40 ml of a 4 wt% aqueous solution of 2-hydroxy-1,3-bisvinylsulfonylpropane.

These emulsions were coated concurrently with a gelatin protective layer dope containing polymethyl methacrylate as a matting agent. The silver coverage was 0.60 g/m$^2$. The support used was a titanium dioxide-containing polyethylene terephthalate film having a subbing layer, and a carbon black layer was provided on the opposite side of the emulsion layer.

The light-sensitive layer sheet prepared as above was superimposed on an image receiving layer sheet prepared in the following manner, and the following processing composition was spread in a thickness of 0.04 mm for diffusion transfer to take place to give a positive image.

A polyethylene-paper laminate sheet was coated with a mixed solution of 22.4 g cellulose acetate (degree of acetylation 55%) and 0.36 g of 3,6-diphenyl-1,4-dimercapto-3H,6H-2,3a,5,6a-tetrazapentalene in a mixture of 179 ml acetone and 45 ml methanol in a coating coverage of 50 ml/m$^2$, followed by drying. Then, a solution of 24 g gum arabic in a mixture of 297 ml water and 297 ml methanol, to which 6 ml of formation (concentration 6%) had been added, was further coated in a coverage of 27.1 ml/m$^2$, followed by drying. Then, a solution of 17.4 g cellulose acetate in a mixture of 653 ml acetone and 69 ml methanol was applied in a coating coverage of 44 ml/m$^2$, followed by drying.

On top of the resulting layer, an alkali solution containing nickel sulfide as a silver precipitating agent was coated in a coverage of 25 ml/m$^2$, followed by drying, aqueous rinse and drying to give an image receiving layer sheet. The alkali solution used above had the following composition.

NaOH: 20 g
$H_2O$: 200 ml
Methanol: 800 ml
Glycerin: 30 g
NiS: 0.06 g

The silver precipitating agent nickel sulfide in the above alkali solution was prepared by reacting a 20% aqueous solution of nickel nitrate with a 20% aqueous solution of sodium sulfide in glycerin under thorough stirring.

The processing composition used was as follows.

Potassium hydroxide (40% KOH in water): 323 ml
Titanium dioxide: 3 g
Hydroxyethylcellulose: 79 g
Zinc oxide: 9.75 g
N,N-bismethoxyethylhydroxylamine: 75 g
Triethanolamine solution (4.5 parts of triethanolamine in 6.2 parts of water): 17.14 g
Tetrahydropyrimidinethione: 0.4 g
2,4-Dimercaptopyrimidine: 0.35 g
Uracil: 90 g
Water: 1193 g The positive image sample obtained by the above diffusion transfer processing was measured for reflection density by means of a Fuji Photographic Film TCD self-recording densitometer. The sensitivity was computed from the amount of exposure corresponding to an optical density of 0.60.

EXAMPLE 2

The procedure of Example 1 was repeated, except that the following image receiving sheet was used to obtain the results shown in Table 2.

Image Receiving Sheet

A polyethylene-paper laminate sheet was coated with a solution of 18 g cellulose acetate (degree of acetylation 54%) and 12 g styrene-maleic anhydride copolymer in a mixture of 270 ml acetone and 30 ml methanol in a coating coverage of 54 ml/m$^2$, followed by drying. On top of this layer was coated a 0.598 wt% solution of 3,6-diphenyl-1,4-dimercapto-3H,6H-2,3a,5,6a-tetrazapentalene in cellulose acetate-acetone in a coverage of 5 g/m$^2$. Then, a 5% aqueous solution of dimethylolurea and a 50% solution of acetic acid were added in 5% and 1.25% concentrations respectively to a 5% aqueous solution of polyacrylamide and the whole mixture was coated on top of the above layer in a coating coverage of 25 ml/m$^2$. On top of this layer was further applied a fine dispersion of palladium sulfide in an acetone/methanol solution of cellulose acetate. This coating solution contained 1-phenyl-5-mercaptoimidazole in an amount sufficient to provide a coverage of $1.25\times10^{-6}$ mole/m$^2$. The dry thickness was 0.8 μm. To this was applied the following alkali solution in a coverage of 18 ml/m$^2$ and the product was rinsed and dried to give an image receiving layer. The above palladium sulfide dispersion was prepared by adding $7\times10^{-3}$ moles of sodium sulfide in methanol and $7\times10^{-3}$ moles of sodium palladium chloride in methanol to a 5.3% solution of cellulose acetate in acetone-methanol and stirring the mixture well.

TABLE 1

| No. | Mixing ratio of emulsions A (wt %) | B | C | Time to separation, 20 seconds: Maximum density | Relative density | Minimum density | Time to separation, 30 seconds: Maximum density | Relative density | Minimum density | Comment |
|---|---|---|---|---|---|---|---|---|---|---|
| 1 | 100 | — | — | 1.50 | 105 | 0.11 | 1.62 | 100 | 0.11 | Comparison |
| 2 | 99 | 1 | — | 1.62 | 102 | 0.11 | 1.73 | 100 | 0.11 | This Invention |
| 3 | 99 | — | 1 | 1.59 | 101 | 0.11 | 1.69 | 98 | 0.11 | This Invention |

It will be apparent from Table 1 that compared with Sample No. 1 which contained only 7%, in number, of silver halide grains 0.4 micron or less in diameter, Samples No. 2 and No. 3 containing at least 20%, in number, of grains 0.4 micron or less in diameter, had maximum densities higher than the value of No. 1 and an image formation time shorter than that of No. 1 by about 10 seconds, even though they were comparable to No. 1 in minimum density.

TABLE 2

| No. | Mixing ratio of emulsions A (wt %) | B | C | Time to separation, 20 seconds: Maximum density | Relative density | Minimum density | Time to separation, 30 seconds: Maximum density | Relative density | Minimum density | Comment |
|---|---|---|---|---|---|---|---|---|---|---|
| 1 | 100 | — | — | 1.48 | 106 | 0.11 | 1.59 | 100 | 0.11 | Comparison |
| 2 | 99 | 1 | — | 1.63 | 101 | 0.11 | 1.72 | 100 | 0.11 | This Invention |
| 3 | 99 | — | 1 | 1.58 | 101 | 0.11 | 1.68 | 99 | 0.11 | This Invention |

It is apparent from Table 2 that Samples No. 2 and No. 3 had maximum densities in excess of the value of Sample No. 1, and formed a complete image about 10 seconds faster than the control, Sample No. 1.

While the invention has been described in detail and with reference to specific embodiments thereof, it will be apparent to one skilled in the art that various changes and modifications can be made therein without departing from the spirit and scope thereof.

What is claimed is:

1. A silver salt diffusion transfer photographic material comprising a silver halide emulsion layer comprising silver halide grains wherein at least 80 percent of the total number of said silver halide grains are accounted for by coarse silver halide grains larger than about 0.6 μm in diameter and fine silver halide grains of from 0.1 to 0.4 μm in diameter, and said fine silver halide grains constitute at least 10 percent of the total number of silver halide grains, wherein said material includes an image receiving layer made of regenerated cellulose containing a silver precipitating agent and is adapted for processing in the presence of a hydroxyl amine developer and a silver halide solvent.

2. A silver salt diffusion transfer photographic material as in claim 1, wherein said coarse silver halide grains have a diameter of from 0.8 to about 3.0 μm.

3. A silver salt diffusion transfer photographic material as in claim 1, wherein said fine silver halide grains constitute from 20 to 80 percent of the total number of silver halide grains.

4. A silver salt diffusion transfer photographic material as in claim 1, wherein said coarse silver halide grains constitute from 80 to 20 percent of the total number of silver halide grains.

5. A silver salt diffusion transfer photographic material as in claim 1 wherein said fine silver halide grains constitute from 20 to 60 percent of the total number of silver halide grains.

6. A silver salt diffusion transfer photographic material as in claim 1, wherein said coarse silver halide grains constitute from 80 to 40 percent of the total number of silver halide grains.

* * * * *